US008638028B2

(12) United States Patent
Zhang et al.

(10) Patent No.: US 8,638,028 B2
(45) Date of Patent: Jan. 28, 2014

(54) LED ILLUMINATION DEVICE AND CONDUCTION STRUCTURE THEREOF

(75) Inventors: Yue-Hong Zhang, Shenzhen (CN); Wen-Hsiang Lu, Taipei Hsien (TW); Huai-Shan Gu, Shenzhen (CN); Fu-Bo Gong, Shenzhen (CN); Ting Dong, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 149 days.

(21) Appl. No.: 12/963,559

(22) Filed: Dec. 8, 2010

(65) Prior Publication Data

US 2012/0062096 A1 Mar. 15, 2012

(30) Foreign Application Priority Data

Sep. 13, 2010 (CN) ..... 2010 1 0279651

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl.

USPC ..... 313/46

(58) Field of Classification Search

USPC ..... 313/46; 362/294

See application file for complete search history.

(56) References Cited

U.S. PATENT DOCUMENTS

| | | | | |
|---|---|---|---|---|
| 2008/0158887 | A1* | 7/2008 | Zhu et al. | 362/294 |
| 2010/0053962 | A1* | 3/2010 | Mo et al. | 362/249.01 |
| 2010/0110691 | A1* | 5/2010 | Hsu et al. | 362/294 |

* cited by examiner

*Primary Examiner* — Anh Mai
*Assistant Examiner* — Zachary J Snyder
(74) *Attorney, Agent, or Firm* — Altis Law Group, Inc.

(57) ABSTRACT

A conduction structure includes a cooling plate and conductive members. A circuit board and a lamp panel are fixed at two sides of the heat cooling plate. The circuit board forms conductive areas. The cooling plate forms conductive areas and first holes with conductive inner faces. The lamp plate defines second holes. The lamp plate forms conductive areas around the second holes on the side away from the heat cooling plate. The conductive areas of the cooling plate contact with the corresponding conductive areas of the circuit board. Each conductive member includes a head and a rod. The rod engages in a corresponding first hole and a corresponding second hole in a transitional fit manner. The head electrically contacts the conductive area of the lamp plate. An LED illumination device using the same conduction structure is also provided.

10 Claims, 4 Drawing Sheets

LED ILLUMINATION DEVICE AND CONDUCTION STRUCTURE THEREOF

BACKGROUND

1. Technical Field

The present disclosure relates to LED illumination devices, especially to a conduction structure of an LED illumination device.

2. Description of Related Art

An LED illumination device often includes a lamp panel with a number of LEDs and a circuit board. The lamp panel is grounded by being connected to the circuit board by a wire. A shell of the LED illumination device is often transparent. Thus, the wire is visible from outside, which negatively impacts the appearance of the LED illumination device.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
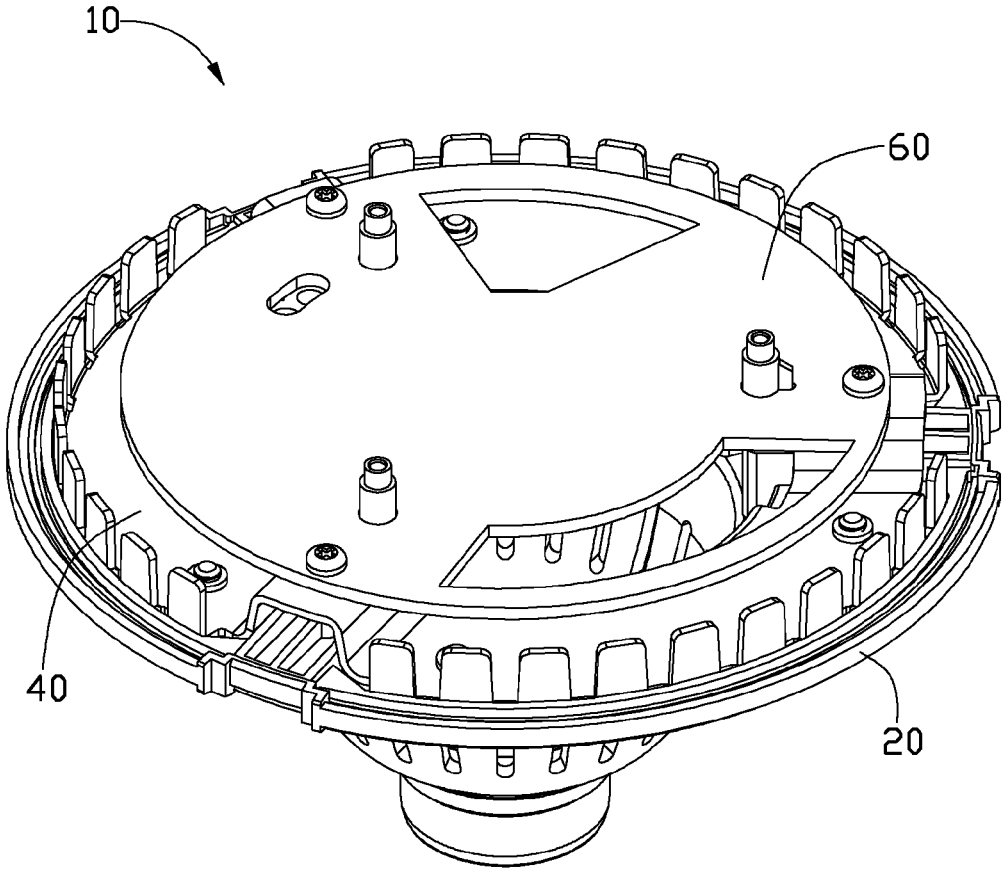
FIG. 1 is an isometric view of an LED illumination lamp according to an exemplary embodiment.
Figure 2:
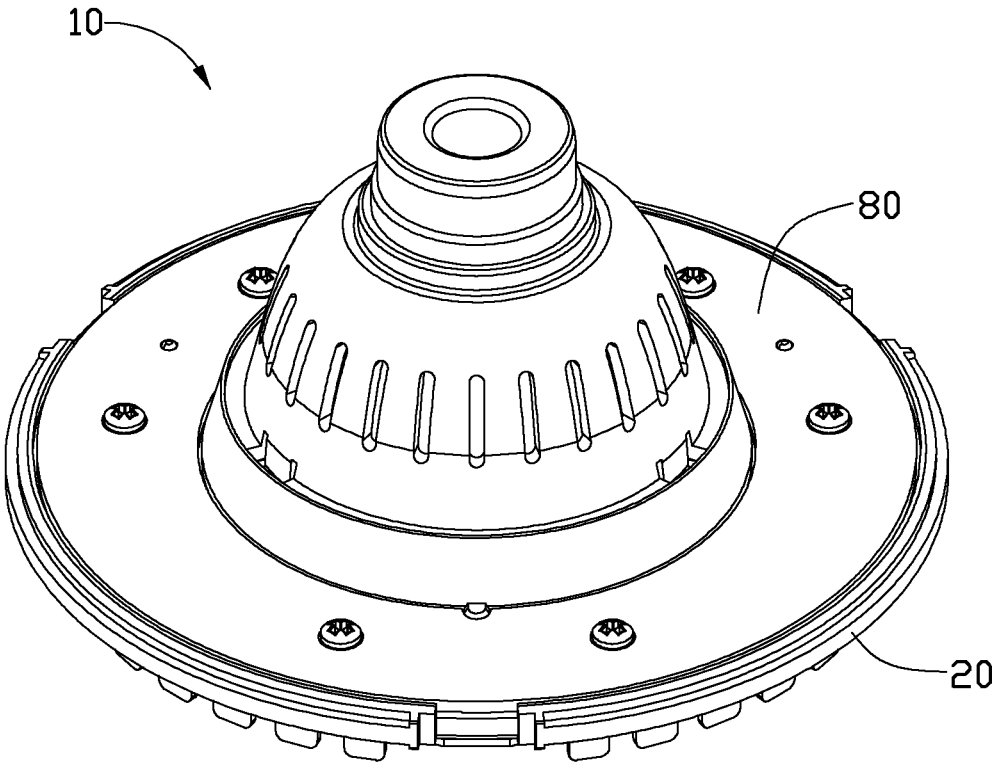
FIG. 2 is similar to FIG. 1, but viewed from a different viewpoint.

Referring to FIGS. 1 and 2, an LED illumination lamp 10 includes a cooling plate 40, a circuit board 60, a support 20, and a lamp panel 80. The circuit board 60 is fixed on one side of the cooling plate 40. The support 20 and the lamp panel 80 are fixed on an opposite side of the cooling plate 40. The support 20 is positioned between the cooling plate 40 and the lamp panel 80.

Figure 3:
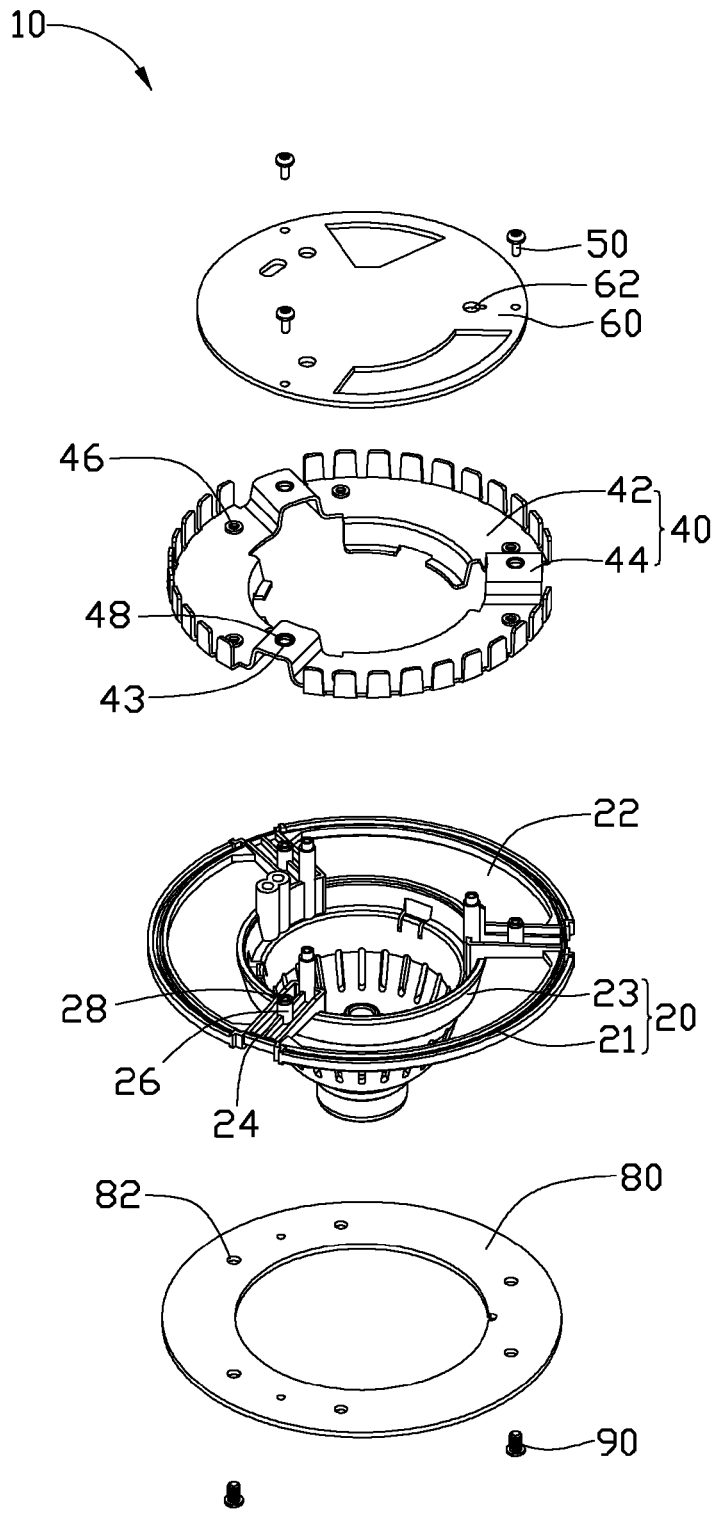
FIG. 3 is an isometric, exploded view of the LED illumination lamp of FIG. 1.

Referring to FIG. 3, the cooling plate 40 can be made of aluminum. In the exemplary embodiment, the surface of the cooling plate 40 is treated by anticathode oxidation to have an anticathode oxidation film formed thereon. The anticathode oxidation film greatly improves the rigidity and anti-corrosion properties of the cooling plate 40 and protects the cooling plate 40. The cooling plate 40 includes a number of base portions 42 and a number of connecting portions 44 connecting each two adjacent base portions 42. Each connecting portion 44 defines a first through hole 48. The anticathode oxidation film around the first through hole 48 is removed to form a first conductive area 43. Each base portion 42 defines two first holes 46.

Figure 4:
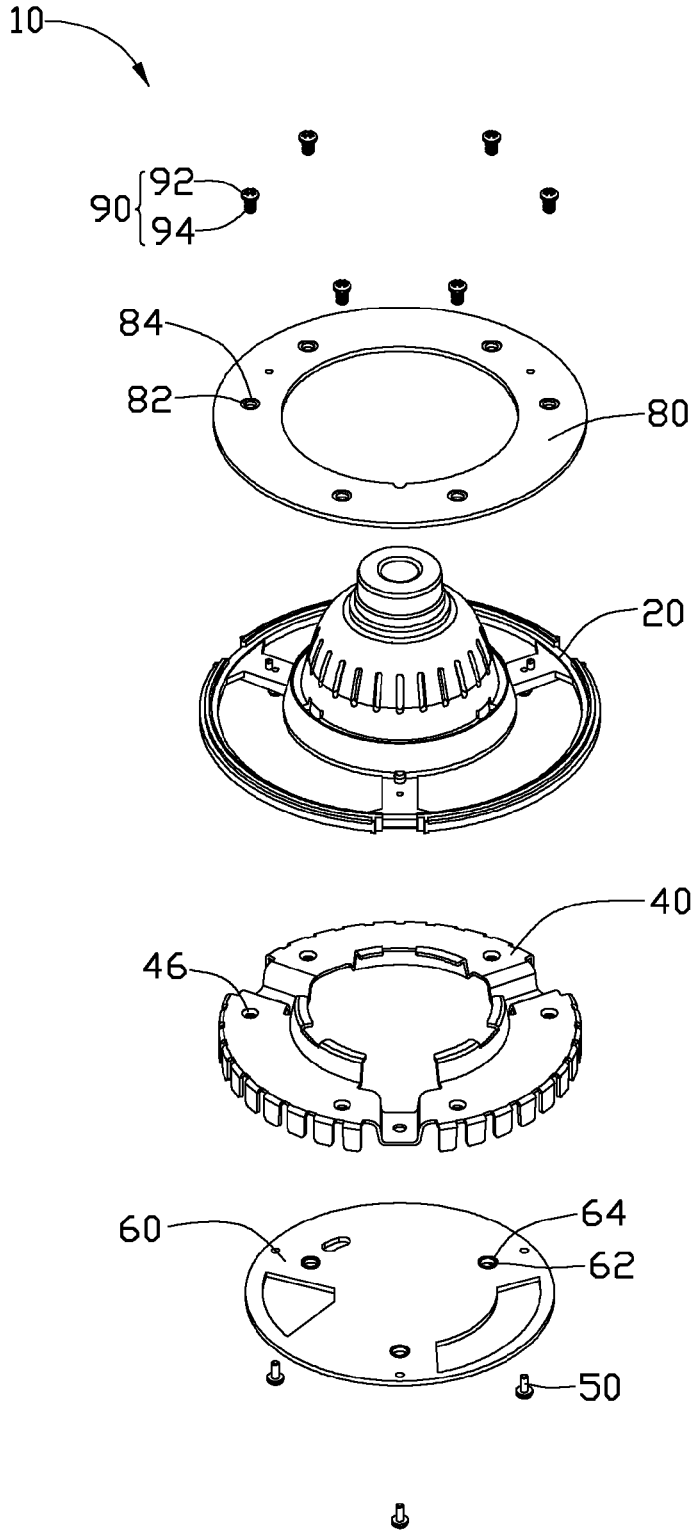
FIG. 4 is similar to FIG. 3, but viewed from a different viewpoint.

The circuit board 60 defines a number of second through holes 62 aligning with the corresponding first through holes 48. Referring to FIG. 4, an insulative paint on the circuit board 60 around the second through hole 62 at a side opposing the cooling plate 40 is removed to form a second conductive area 64.

The support 20 includes a brim 21 and a body 23. The brim 21 of the support 20 defines a number of openings 22 configured for receiving the base portions 42. A fixing bar 24 is formed between each two adjacent openings 22. Each fixing bar 24 includes a protruding post 26 defining a hole 28. A bolt 50 extends through the second through hole 60 and the first through hole 48 and is screwed into the hole 28, to fix the cooling plate 40 and the circuit board 60 to the support 20. The first conductive area 43 contacts the second conductive area 64, thereby the cooling plate 40 is electrically connected to the circuit board 60.

The lamp panel 80 defines a number of second holes 82. The first holes 46 and the second holes 82 are both threaded holes. The bolts 90 are screwed into the second hole 82 and the first hole 46 in a transitional fit manner, to fix the lamp panel 80 to the cooling plate 40. Referring to FIG. 4, a number of light emitting diodes (not shown) are mounted at a side of the lamp panel 80 away from the cooling plate 40. An insulative film of the lamp panel 80 around the second holes 82 at the side same as the light emitting diodes is removed to form a third conductive area 84.

As each bolt 90 is screwed into the corresponding the first hole 46 and the second hole 82, thread of the bolt 90 breaks the anticathode oxidation film of the inner surface of the first hole 46, causing an inner surface of the first hole 46 to be electrically conductive. A head 92 of the bolt 90 contacts the third conductive area 84. A rod 94 of the bolt 90 contacts the inner surface of the first hole 46. When the LED illumination device 10 works, the lamp panel 80 is electrically connected to the bolt 90 by the head 92 contacting the third conductive area 84, and the bolt 90 is electrically connected to the cooling plate 40 by the rod 94 contacting the first hole 46. The lamp panel 80 is thus electrically connected to the cooling plate 40. Because the cooling plate 40 is electrically connected to the circuit board 60, the lamp panel 80 is able to electrically connected to the circuit board 60 by the cooling plate 40.

In an alternative embodiment, the first hole 46 and the second hole 82 may be unthreaded holes. The inner surface of the first hole 46 is not treated by anticathode oxidation. Because the cooling plate 40 can be made of aluminum, the inner surface of the first hole 46 is conductive. The bolt 90 is replaced by a conductive member, which includes a head and a rod. The head contacts the third conductive area 84. The rod engages in the first hole 46 and the second hole 82 in a transition fit manner to contact the inner surface of the first hole 46.

In an alternative embodiment, the surface of the cooling plate 40 may be left untreated by anticathode oxidation. The cooling plate 40 can directly contact the first conductive area 43 of the circuit board 60.

The lamp panel 80 is electrically connected to the circuit board 89 of the LED illumination device 10 by treating the surface of the cooling plate 40, the circuit board 60, and the lamp panel 80, which will not have a negative influence on the appearance of the LED illumination device 10.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED illumination lamp comprising:

a cooling plate;

a circuit board;

a support;

a lamp panel; and a plurality of conductive members;

wherein the circuit board is fixed on one side of the cooling plate, the support and the lamp panel are fixed on an opposite side of the cooling plate, the support is positioned between the cooling plate and the lamp panel, the circuit board forms a plurality of conductive areas, the cooling plate forms a plurality of conductive areas and defines a plurality of first holes with conductive inner faces, the lamp panel defines a plurality of second holes, the lamp panel is formed with a plurality of conductive areas around the corresponding second holes on a side away from the cooling plate, the conductive areas of the cooling plate contact the corresponding conductive areas of the circuit board, each conductive member includes a head and a rod, the rod engages in a corresponding first hole and a corresponding second hole in a transitional fit manner, the head contacts the conductive area of the lamp panel, the lamp panel being electrically connected to the circuit board by the cooling plate.

2. The LED illumination lamp of claim 1, wherein the cooling plate includes a plurality of connecting portions, each connecting portion defines a first through hole, the circuit board defines a plurality of second through holes, the support includes a protruding post defining a hole, a bolt extends through the second through hole and the first through hole and engages in the hole to fix the cooling plate and the circuit board to the support.

3. The LED illumination lamp of claim 1, wherein the conductive member is a bolt, the first hole and the second hole are both threaded holes.

4. The LED illumination lamp of claim 1, wherein the conductive area of the circuit board is formed by removing an insulative paint on the circuit board.

5. The LED illumination lamp of claim 1, wherein the conductive area of the lamp panel is formed by removing an insulative film of the lamp panel.

6. A conduction structure configures configured for conducting a lamp panel to a circuit board for an LED illumination device comprising:

a cooling plate;

a lamp panel;

a circuit board; and a plurality of conductive members;

wherein the circuit board and the lamp panel are fixed beside two sides of the heat cooling plate, the circuit board forms a plurality of conductive areas, the cooling plate forms a plurality of conductive areas and defines a plurality of first holes with conductive inner faces, the lamp panel defines a plurality of second holes, the lamp panel is formed with a plurality of conductive areas around the corresponding second holes on a side away from the cooling plate, the conductive areas of the cooling plate contact the corresponding conductive areas of the circuit board, each conductive member includes a head and a rod, the rod engages in a corresponding first hole and a corresponding second hole in a transitional fit manner, the head contacts with the conductive area of the lamp panel, the lamp panel being electrically connected to the circuit board by the cooling plate.

7. The conduction structure of claim 6, wherein the cooling plate is made of aluminum, the surface of the cooling plate is treated by anticathode oxidation, the conductive area of cooling plate is formed by removing the anticathode oxidation film.

8. The conduction structure of claim 6, wherein the conductive member is bolt, the first hole and the second hole are both threaded holes.

9. The conduction structure of claim 6, wherein the conductive area of the circuit board is formed by removing an insulative paint on the circuit board.

10. The conduction structure of claim 6, wherein the conductive area of lamp panel is formed by removing an insulative film of the lamp panel.

* * * * *